US006450980B1

(12) United States Patent
Robbins et al.

(10) Patent No.: US 6,450,980 B1
(45) Date of Patent: Sep. 17, 2002

(54) MASSAGE DEVICE WITH FLEXIBLE FINGERS

(76) Inventors: Wendy Robbins, P.O. Box 6870, Pine Mountain, CA (US) 93222; Jorli McLain, 15141 Acacia Way, Pine Mtn., CA (US) 93222

( * ) Notice: Subject to any disclaimer, the term of this patent is extended or adjusted under 35 U.S.C. 154(b) by 84 days.

(21) Appl. No.: 09/621,952

(22) Filed: Jul. 21, 2000

(51) Int. Cl.[7] ..... A61H 7/00
(52) U.S. Cl. ..... 601/137; 601/136; 601/15
(58) Field of Search ..... 601/134, 135, 601/136, 137, 107, 111, 133

(56) References Cited

U.S. PATENT DOCUMENTS

| | | | | | |
|---|---|---|---|---|---|
| 1,663,908 | A | * | 3/1928 | Fuld | 15/191.1 |
| 5,728,050 | A | * | 3/1998 | Lin | 601/107 |
| 6,309,365 | B1 | * | 10/2001 | Lacey | 601/137 |

FOREIGN PATENT DOCUMENTS

| | | | | |
|---|---|---|---|---|
| AT | 000041606 B | * | 3/1910 | 601/107 |
| AU | 134633 | | 8/1998 | |

* cited by examiner

*Primary Examiner*—Michael A. Brown
*Assistant Examiner*—Benjamin K. Koo
(74) *Attorney, Agent, or Firm*—Donald J. Lenkszus

(57) ABSTRACT

A massage device for the head or scalp has flexible, metallic prongs or fingers. The massage device includes a handle and a plurality of flexible, elongated members protruding from the handle. Each of the plurality of flexible, elongated members are bendable. In one embodiment, the handle includes a hollow body, end caps, and a solid insert member. The plurality of flexible, elongated members are attached to the handle by compression fitting between the end caps and the insert member. In another embodiment, the handle includes a hollow body, end caps, and a solid resilient filler material. The plurality of flexible, elongated members are attached to the handle by the solid resilient filler material, which may be solidified around the plurality of flexible, elongated members. In a further embodiment, the plurality of flexible, elongated members are made of nitinol material, which is a shape memory alloy. This permits the user to restore the plurality of flexible, elongated members to their original shape by heating of the nitinol wires. In another embodiment, each of the plurality of flexible, elongated members has a portion which is bendable and the bending thereof is electrically controllable. The bending may be accomplished by use of a plurality of strips composed of electro-responsive material. Such materials can change in length, for example, under application of electrical current or by heating thereof using electrical current.

19 Claims, 4 Drawing Sheets

MASSAGE DEVICE WITH FLEXIBLE FINGERS

FIELD OF THE INVENTION

The present invention relates to massage devices. More particularly, the invention relates to a massage device for the head or scalp, and having flexible, metallic prongs or fingers, the prongs being readily bendable or repositionable.

BACKGROUND OF THE INVENTION

Massage devices for the head and scalp are known in the art.

U.S. Pat. No. 1,111,427 to Archibald relates to a massage appliance having a roller body, handle, and a plurality of protrusions on the roller. Each protrusion has itself a plurality of protrusions.

U.S. Pat. No. 4,506,659 to Chester teaches a scalp massager having the form of a helmet. Inside the helmet are massaging elements having short, resilient projections.

U.S. Pat. No. 3,373,739 to Rankin teaches an apparatus for massaging scalp using rotating brushes. The brushes are applied to the scalp using a headphone-like support member, and electrical power is supplied to cause the rotation of the rotating brushes.

U.S. Pat. No. Des. 405,537 to Taylor et al. teaches a vibrating body massager. The massager is attachable to the head of a user, and projecting portions contact the face of the user.

U.S. Pat. No. Des. 368,141 to Rabin et al. teaches a scalp massager having a helmet-like shape.

U.S. Pat. No. Des. 348,520 to Wolf teaches a therapeutic appliance for stress relief. The appliance is in the form a helmet with an electrically-operated vibration element.

U.S. Pat. No. Des. 260,553 to Wu teaches a vibrating massaging mask. The mask is attachable to the head of a wearer.

U.S. Pat. No. Des. 293,932 to Ramseyer teaches a massaging head and face mask. The mask completely covers the head and most of the face, except for the eyes and nose.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a massage device for the head or scalp having flexible, metallic prongs or fingers.

These and other objects according to the present invention are accomplished by provision of a massage device for the head or scalp, and having flexible, metallic prongs or fingers.

More specifically, the massage device according to the present invention includes a handle, and a plurality of flexible, elongated members protruding from the handle. Each of the plurality of flexible, elongated members are bendable in the preferred embodiment.

In one embodiment, the handle includes a hollow body, end caps, and a solid insert member. The plurality of flexible, elongated members are attached to the handle by compression fitting between the end caps and the insert member.

In another embodiment, the handle includes a hollow body, end caps, and a solid resilient filler material. The plurality of flexible, elongated members are attached to the handle by the solid resilient filler material, which may be solidified around the plurality of flexible, elongated members.

In a further embodiment, the plurality of flexible, elongated members are made of nitinol material, which is a shape memory alloy. This permits the user to restore the plurality of flexible, elongated members to their original shape by heating of the nitinol wires. This is used, for example, when the plurality of flexible, elongated members have been deformed from their original condition, and the user wishes to restore them to that condition.

In another further embodiment, each of the plurality of flexible, elongated members has a portion which is bendable and the bending thereof is electrically controllable. The bending may be accomplished by use of a plurality of strips composed of electro-responsive material. Such materials can change in length, for example, under application of electrical current or by heating thereof using electrical current.

Other objects and advantages of the present invention will be more readily apparent from the following detailed description when read in conjunction with the accompanying drawings.

DETAILED DESCRIPTION OF THE INVENTION

Figure 1:
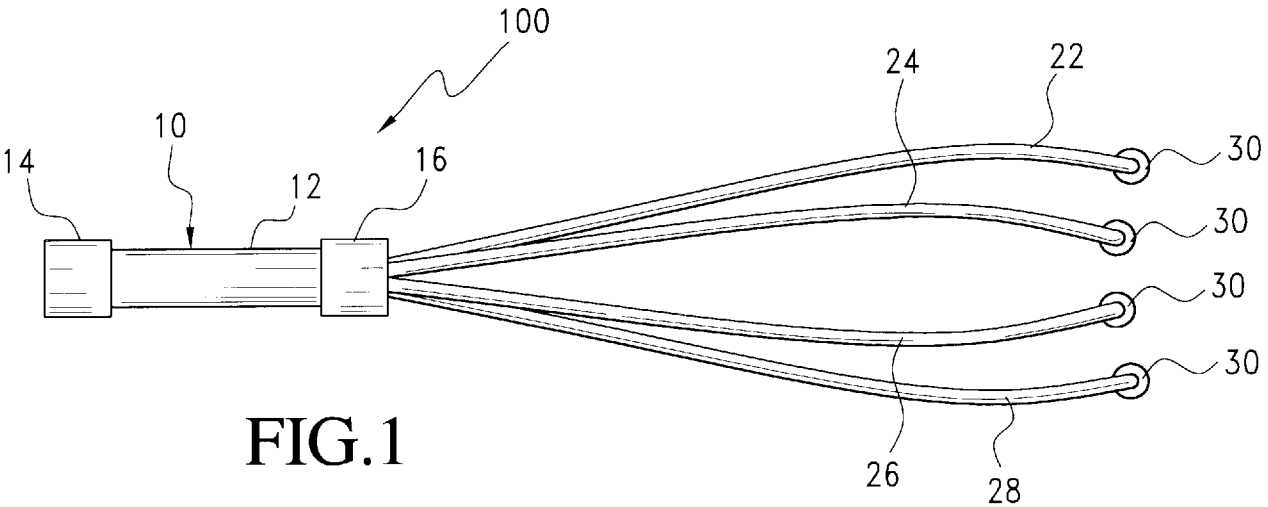
FIG. 1 is a side elevational view of a massage device according to the present invention.

A massage device 100 is shown in FIG. 1, and includes a handle 10 and a plurality of flexible, elongated members 22, 24, 26, 28 protruding from the handle 10. Each of the plurality of flexible, elongated members 22, 24, 26, 28 are bendable, and may be composed, for example, of copper material or other metal or metal alloy.

The flexible, metallic prongs or fingers 22, 24, 26, and 28 are preferably sufficiently stiff as to retain their position and shape. They are somewhat resilient, inasmuch as they will return to their initial positions after application of a force thereto less than a bending force. However, upon application of a force sufficient to cause bending, once bent by a user so as to be moved to another position or formed into another shape under a bending force, the flexible, metallic prongs or fingers 22, 24, 26, and 28 will stay in that shape.

As shown in FIG. 1, each of the flexible, metallic prongs or fingers 22, 24, 26, 28 has a covering at its tip. Specifically, each of the flexible, metallic prongs or fingers 22, 24, 26, 28 has a respective covering 30. The covering 30 is preferably a soft, resilient plastic coating, to protect the scalp against injury or damage. The covering 30 can be applied to the tips by dipping in liquid plastic material, for example. It is also contemplated as being within the scope of the present invention that each of the coverings 30 could be a pre-molded piece which is slid over respective ones of the tips of the fingers 22, 24, 26, and 28, and secured thereon frictionally or by adhesive. All such variations are contemplated as being within the scope of the present invention.

It is contemplated as being within the scope of the present invention that each of the plurality of flexible, elongated members 22, 24, 26, 28 may be composed of other suitable materials for use as a massage device, for example, flexible plastic or rubber material. All such variations are contemplated as being within the scope of the present invention.

The handle 10 includes an end cap 14, a tubular body portion 12, and an end cap 16. The end caps 14 and 16 can, for example, be secured to the tubular body portion 12 by use of mating screw threads. Alternatively, the end caps 14 and 16 can be secured to the tubular body portion 12 by use of glue or adhesive, or by welding or soldering. All such variations are contemplated as being within the scope of the present invention.

Figure 2:
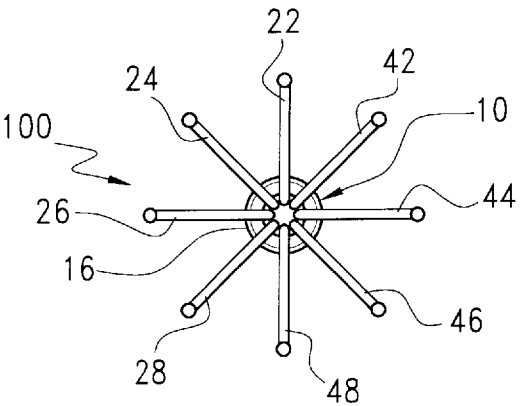
FIG. 2 is an end elevational view of the device of FIG. 1 as seen from the right side thereof.

FIG. 2, which is an end elevational view of the device of FIG. 1 as seen from the right side thereof, shows an additional four flexible, metallic prongs or fingers 42, 44, 46, and 48, whose view in FIG. 1 was obstructed by corresponding ones of the flexible, metallic prongs or fingers 22, 24, 26, 28. As seen in FIG. 2, the flexible, metallic prongs or fingers 22, 24, 26, 28, 42, 44, 46, and 48 extend approximately equi-angularly from the end cap 16 of the handle 10.

Figure 3:
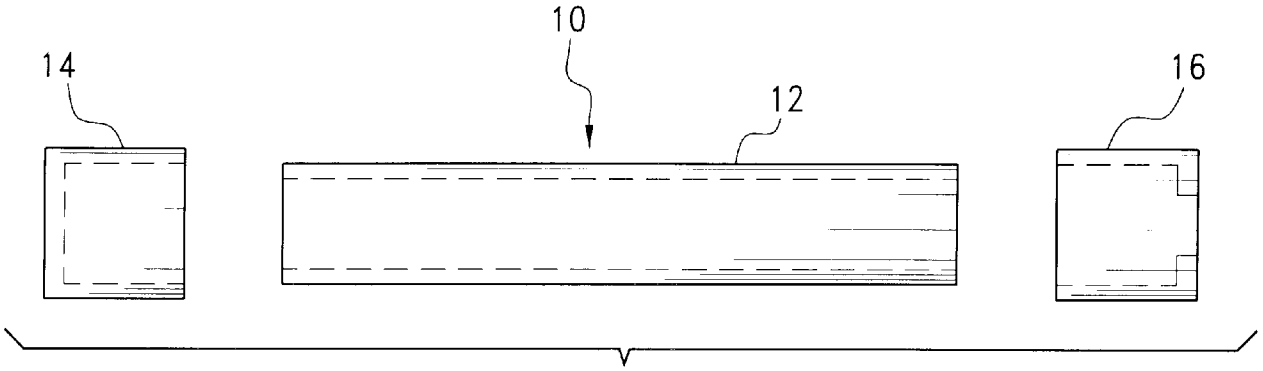
FIG. 3 is an assembly view of a handle portion of the device of FIG. 1.

FIG. 3 is an assembly view of a handle portion 10 of the massage device 100 of FIG. 1. In this view, dashed lines illustrate the interior structures of the tubular body portion 12, the end cap 14, and the end cap 16. These elements are shown in greater detail in FIGS. 4–7, as described further hereunder.

Figure 4:
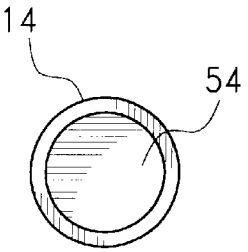
FIG. 4 is an end view of an end cap of the handle portion of FIG. 3.

FIG. 4 is an end view of end cap 14 of the handle portion 10 of FIG. 3. As seen in this view, the end cap 14 has a peripheral tubular wall and a solid end face 54.

Figure 5:
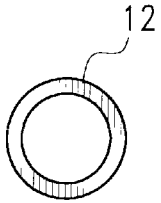
FIG. 5 is an end view of a tubular body portion of the handle portion of FIG. 3.

FIG. 5 is an end view of the tubular body portion 12 of the handle portion 10 of FIG. 3. As seen in this view, the tubular body portion 12 has a hollow cylindrical shape.

Figure 6:
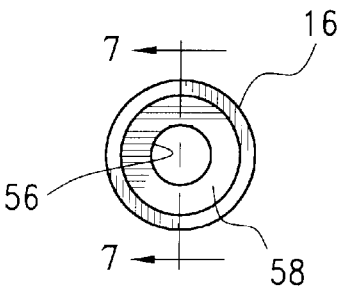
FIG. 6 is an end view of another end cap of the handle portion of FIG. 3, having an aperture therethrough.

FIG. 6 is an end view of the end cap 16 of the handle portion 10 of FIG. 3. As seen in this view, the end cap 16 has a peripheral tubular wall and an end face 58. The end face 58 has a circular aperture 56 formed therethrough.

Figure 7:
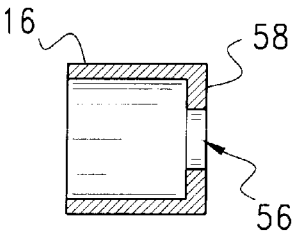
FIG. 7 is a sectional view of the end cap of FIG. 6, taken along line 7—7 of FIG. 6.

FIG. 7 is a sectional view of the end cap 16 of FIG. 6, taken along line 7—7 of FIG. 6. As seen in this view, the circular aperture 56 and the end face 58 are seen clearly.

Figure 8:
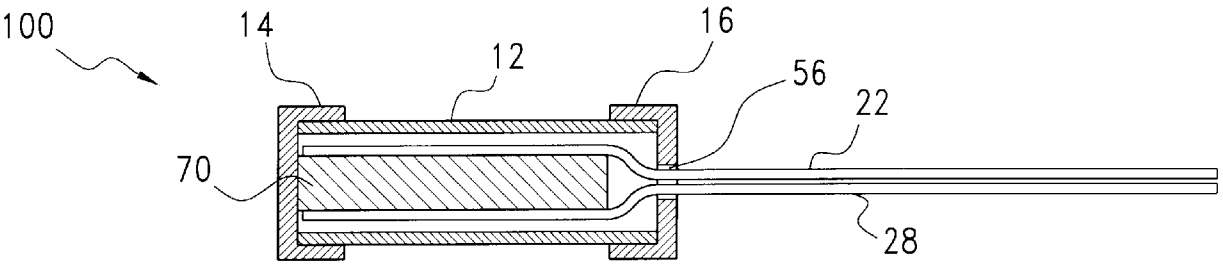
FIG. 8 is a sectional view taken longitudinally of the massage device of FIG. 1, of one embodiment of the handle construction using an insert member.

FIG. 8 is a sectional view taken longitudinally of the massage device 100 of FIG. 1, of one embodiment of the construction of the handle 10. In this embodiment, an insert member 70 is provided. The insert member 70 is provided to frictionally secure the flexible, metallic prongs or fingers 22, 24, 26, 28, 42, 44, 46, and 48 inside the handle 10. For the sake of clarity, only two of the flexible, metallic prongs or fingers 22 and 28 are shown in this view. Also for the sake of clarity, the size of the insert member 70 is schematically shown in this view, and is not to scale with the other parts. The insert member 70 in practice will be sufficiently large that, when the end cap 14 and the end cap 16 are secured to the tubular body portion 12, the flexible, metallic prongs or fingers 22, 24, 26, 28, 42, 44, 46, and 48 will be compressed between the insert member 70 and the end cap 14, the end cap 16, and the tubular body portion 12. Other types of compression fitting are known, and all such variations are contemplated as being within the scope of the present invention.

Figure 9:
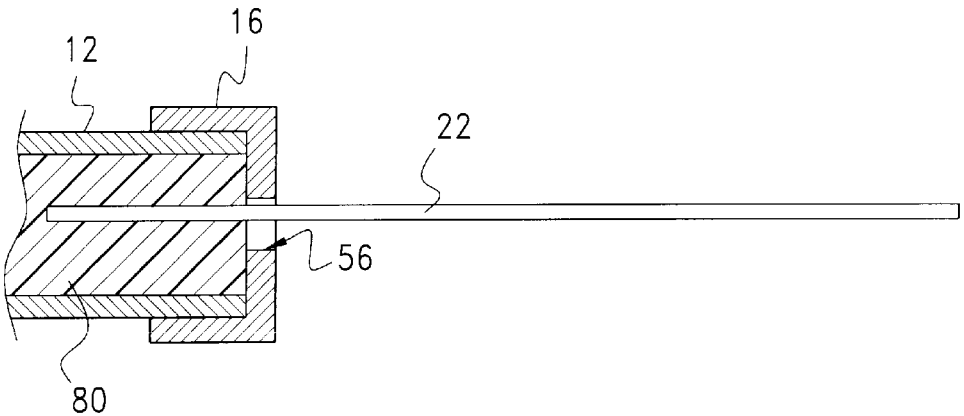
FIG. 9 is a sectional view taken longitudinally of the massage device of FIG. 1, of another embodiment of the handle construction using a solid retaining material.

FIG. 9 is a sectional view taken longitudinally of the massage device 100 of FIG. 1, of another embodiment of the construction of the handle 10 using a solid retaining material 80 therein. In this embodiment, the solid retaining material 80 is provided to secure the flexible, metallic prongs or fingers 22, 24, 26, 28, 42, 44, 46, and 48 inside the handle 10. The solid retaining material 80 is provided to secure the flexible, metallic prongs or fingers 22, 24, 26, 28, 42, 44, 46, and 48 inside the handle 10. For the sake of clarity, only one of the flexible, metallic prongs or fingers 22 is shown in this view. The plurality of flexible, metallic prongs or fingers 22, 24, 26, 28, 42, 44, 46, and 48 are thereby attached to the handle 10 by the solid resilient filler material (solid retaining material) 80, which may be solidified around the plurality of flexible, elongated members. For example, rubber or plastic may be used in liquid form by pouring or injection into the tubular body portion 12, and then permitted to solidify or harden. All such variations are contemplated as being within the scope of the present invention.

Figure 10:
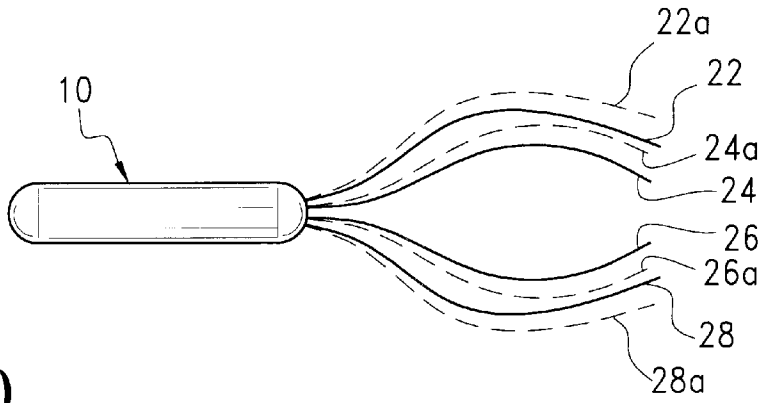
FIG. 10 is an alternative embodiment of the massage device of FIG. 1, in which the wires are composed of shape memory alloy.

FIG. 10 is an alternative embodiment of the massage device 100 of FIG. 1, in which the flexible, metallic prongs or fingers 22, 24, 26, 28, 42, 44, 46, and 48 are composed of nitinol material, which is a shape memory alloy. This permits the user to restore the flexible, metallic prongs or fingers 22, 24, 26, 28, 42, 44, 46, and 48 to their original shape (shown in dashed outline in FIG. 10) by heating of the nitinol wires. This is used, for example, when the flexible, metallic prongs or fingers 22, 24, 26, 28, 42, 44, 46, and 48 have been deformed from their original condition, and the user wishes to restore them to that condition. Other shape memory alloys are known and can be used in the present invention, and all such variations are contemplated as being within the scope of the present invention. In the restored position, the flexible, metallic prongs or fingers are renumbered as 22*a*, 24*a*, 26*a*, and 28*a*. The flexible, metallic prongs or fingers 42, 44, 46, and 48 are not visible in this view, being obstructed by the corresponding ones of the fingers 22, 24, 26, and 28. This permits the user to restore the plurality of flexible, elongated members to their original shape by heating of the nitinol wires. This is used, for example, when the plurality of flexible, elongated members have been deformed from their original condition, and the user wishes to restore them to that condition.

Figure 11:
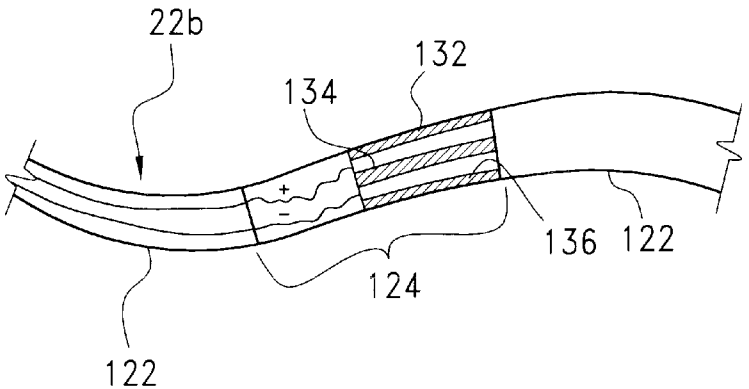
FIG. 11 is an alternative embodiment of the massage device of FIG. 1, in which the wires each have a controllably bendable portion.

FIG. 11 is an alternative embodiment of the massage device of FIG. 1, in which each of the flexible, metallic prongs or fingers 22, 24, 26, 28, 42, 44, 46, and 48 includes a controllably bendable portion 124. One such prong or finger 22*b* is shown, having a pair of electrical leads (unnumbered) supplying electrical current to strips 132, 134, and 136. Such strips can be of electro-responsive material, of the type which contracts, or may be of a bimetallic construction which, when supplied with electrical current, bends. In this alternative embodiment, the bending may be accomplished by use of the plurality of strips 132, 134, 136, and other strips not visible in FIG. 11, which are composed of electro-responsive material. Such materials can change in length, for example, under application of electrical current or by heating thereof using electrical current. Nitinol wires can be embedded in the strips 132, 134, and 136, for example, as such wires are already used in high-speed camera shutters to suddenly contract under application of electrical current.

The invention being thus described, it will be evident that the same may be varied in many ways. Such variations are not to be regarded as a departure from the spirit and scope of the invention and all such modifications are intended to be included within the scope of the claims.

What is claimed is:

1. A massage device for the head or scalp, comprising:

a handle portion; and a plurality of flexible fingers extending from the handle portion, and each having a free end;

said handle portion comprising a tubular hollow body, a second end cap secured to and closing one end of said tubular hollow body, said second end cap having an aperture therethrough, said plurality of flexible fingers extending through said aperture, each flexible finger of said plurality of flexible fingers including an end portion secured in said tubular hollow body;

said handle portion further comprising means cooperating with said tubular hollow body for securing each flexible finger end portion within said tubular hollow body.

2. A massage device in accordance with claim 1, wherein:

each said flexible finger is resiliently deform able.

3. The massage device of claim 1, wherein the plurality of flexible fingers are deformably bendable under a force greater than a minimum bending force.

4. The massage device of claim 1, wherein the plurality of flexible fingers are resiliently deformable, and wherein the plurality of flexible fingers are deformably bendable under a force greater than a minimum bending force.

5. A massage device in accordance with claim 1, wherein:

each flexible finger comprises a covering disposed on the tip of each free end.

6. A massage device in accordance with claim 5, wherein;

each said covering comprises a soft, resilient plastic coating.

7. The massage device of claim 1, wherein each of said plurality of flexible fingers is yieldingly deformable so as to retain its position once it is bend under a force exceeding a bending force.

8. The massage device of claim 1, further comprising a solid resilient filler material disposed in said hollow body, for retaining each of the plurality of flexible fingers therein.

9. The massage device of claim 1, wherein each of the plurality of flexible, elongated members are made of nitinol material, which is a shape memory alloy, to permit the plurality of flexible fingers to regain their original shape when heated.

10. The massage device of claim 1, wherein each of the plurality of flexible, fingers includes an electrically-controlled bendable portion.

11. The massage device of claim 10, wherein said electrically-controlled bendable includes a plurality of strips composed of electro-responsive material which can change in length under application of electrical current.

12. The massage device of claim 10, wherein said electrically-controlled bendable includes a plurality of strips composed of electro-responsive material which can change in length under application of heat, the heat being generated by said electrical current.

13. A massage device in accordance with claim 1, wherein:

each flexible finger comprises metal.

14. A massage device in accordance with claim 1, wherein:

each flexible finger comprises copper.

15. A massage device in accordance with claim 1, wherein:

said handle portion comprises a first end cap secured to the other end of said tubular hollow body, first end cap comprises an integrally formed solid end face and a peripheral tubular wall, said peripheral tubular wall engaging said tubular hollow body.

16. A massage device in accordance with claim 15, wherein:

said second end cap comprises an integrally formed apertured end face and a peripheral tubular wall, said second end cap peripheral tubular wall engaging said tubular hollow body.

17. A massage device in accordance with claim 1, wherein:

said second end cap comprises an integrally formed apertured end face and a peripheral tubular wall, said second end cap peripheral tubular wall engaging said tubular hollow body.

18. A massage device in accordance with claim 1, comprising;

a first end cap secured to and closing the other end of said tubular hollow body.

19. A massage device for the head or scalp, comprising:

a handle portion; and a plurality of flexible fingers extending from the handle portion, and each having a free end;

said handle portion comprising a tubular hollow body, a second end cap secured to and closing one end of said tubular hollow body, said second end cap having an aperture therethrough, said plurality of flexible fingers extending through said aperture, each flexible finger of said plurality of flexible fingers including an end portion secured in said tubular hollow body;

said handle portion further comprising means cooperating with said tubular hollow body for securing each flexible finger end portion within said tubular hollow body;

said means comprises an insert member disposed in said tubular hollow body, for retaining each said flexible finger end portion therein.

* * * * *

US006450980C1

(12) EX PARTE REEXAMINATION CERTIFICATE (5773rd)

United States Patent

Robbins et al.

(10) Number: US 6,450,980 C1

(45) Certificate Issued: Jun. 5, 2007

(54) MASSAGE DEVICE WITH FLEXIBLE FINGERS

(76) Inventors: Wendy Robbins, P.O. Box 6870, Pine Mountain, CA (US) 93222; Jorli McLain, 15141 Acacia Way, Pine Mtn., CA (US) 93222

Reexamination Request:
No. 90/007,941, Feb. 17, 2006

Reexamination Certificate for:

| | |
|---|---|
| Patent No.: | **6,450,980** |
| Issued: | **Sep. 17, 2002** |
| Appl. No.: | **09/621,952** |
| Filed: | **Jul. 21, 2000** |

(51) Int. Cl.
*A61H 7/00* (2006.01)

(52) U.S. Cl. ..... 601/137; 601/136; 601/15

(58) Field of Classification Search ..... None
See application file for complete search history.

(56) References Cited

U.S. PATENT DOCUMENTS

| | | | |
|---|---|---|---|
| 126,512 | A | 5/1872 | Beardley |
| 401,058 | A | 4/1889 | Pfau |
| 567,684 | A | 9/1896 | Moody |
| 866,909 | A | 9/1907 | Brennar |
| 871,247 | A | 11/1907 | Tomlinson |
| 1,706,862 | A | 3/1929 | Rickersberg |
| 2,499,074 | A | 2/1950 | Nordgarden |
| 3,412,983 | A | 11/1968 | Kesilman |
| 5,688,045 | A | 11/1997 | Butte |
| 5,788,368 | A | 8/1998 | Anderson |
| 6,206,561 | B1 | 3/2001 | Hefti |
| 6,309,365 | B1 | 10/2001 | Lacey |

OTHER PUBLICATIONS

Stuff Magazine, Stress–Busters Test, Orgasmatron (Oct. 1999).

WIKIPEDIA, Glastonbury Festival (Feb. 11, 2006).

Everything for Love.com, Inc., Plaintiff's Amended and Supplemental Response to First Request for Admissions, (May 25, 2004).

State of Nevada, Secretary of State, Corporate Records on Everything for Love.com, Inc. (Feb. 11, 2006).

*Primary Examiner*—Bibhu Mohanty

(57) ABSTRACT

A massage device for the head or scalp has flexible, metallic prongs or fingers. The massage device includes a handle and a plurality of flexible, elongated members protruding from the handle. Each of the plurality of flexible, elongated members are bendable. In one embodiment, the handle includes a hollow body, end caps, and a solid insert member. The plurality of flexible, elongated members are attached to the handle by compression fitting between the end caps and the insert member. In another embodiment, the handle includes a hollow body, end caps, and a solid resilient filler material. The plurality of flexible, elongated members are attached to the handle by the solid resileint filler material, which may be solidified around the plurality of flexible, elongated members. In a further embodiment, the plurality of flexible, elongated members are made of nitinol material, which is a shape memory alloy. This permits the user to restore the plurality of flexible, elongated members to their original shape by heating of the nitinol wires. In another embodiment, each of the plurality of flexible, elongated members has a portion which is bendable and the bending thereof is electrically controllable. The bending may be accomplished by use of a plurality of strips composed of electro-responsive material. Such materials can change in length, for example, under application of electrical current or by heating thereof using electrical current.

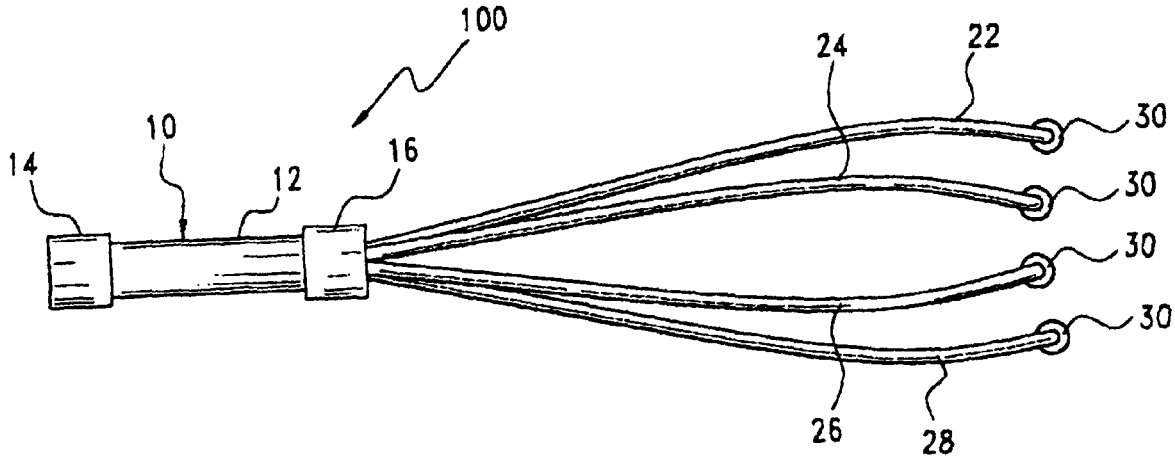

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–19 is confirmed.

* * * * *